US008747102B2

(12) United States Patent
Boguszewski et al.

(10) Patent No.: US 8,747,102 B2
(45) Date of Patent: Jun. 10, 2014

(54) IGNITOR SPARK STATUS INDICATOR

(75) Inventors: Stanley Joseph Boguszewski, Russell, MA (US); Paul Herbert Chase, Suffield, CT (US)

(73) Assignee: ALSTROM Technology Ltd, Baden (CH)

( * ) Notice: Subject to any disclaimer, the term of this patent is extended or adjusted under 35 U.S.C. 154(b) by 891 days.

(21) Appl. No.: 12/846,063

(22) Filed: Jul. 29, 2010

(65) Prior Publication Data

US 2012/0028199 A1 Feb. 2, 2012

(51) Int. Cl.
*F23D 5/12* (2006.01)

(52) U.S. Cl.
USPC ..... 431/13; 431/24; 431/69; 431/74

(58) Field of Classification Search
USPC ..... 431/13, 18, 74, 78, 69, 24, 25, 26
See application file for complete search history.

(56) References Cited

U.S. PATENT DOCUMENTS

| | | | | |
|---|---|---|---|---|
| 2,798,632 | A | 4/1957 | Smits | |
| 2,858,779 | A | 11/1958 | Rotzler | |
| 3,122,196 | A | 2/1964 | Schuss | |
| 3,238,447 | A * | 3/1966 | Bychinsky | 324/394 |
| 3,291,183 | A * | 12/1966 | Fairley | 431/66 |
| 4,033,711 | A | 7/1977 | Christian et al. | |
| 4,090,125 | A * | 5/1978 | Warner | 324/399 |
| 4,518,345 | A * | 5/1985 | Mueller et al. | 431/24 |
| 4,608,536 | A * | 8/1986 | Jacobs et al. | 324/399 |
| 4,731,586 | A * | 3/1988 | Perkins | 324/536 |
| 5,049,063 | A | 9/1991 | Kishida et al. | |
| 5,106,293 | A | 4/1992 | Hawkins | |
| 5,470,223 | A * | 11/1995 | McCoy | 431/24 |
| 5,599,180 | A | 2/1997 | Peters et al. | |
| 5,938,424 | A * | 8/1999 | Kurogi et al. | 431/13 |
| 6,680,614 | B2 * | 1/2004 | Tekriwal et al. | 324/396 |
| 6,717,412 | B1 * | 4/2004 | Moritz et al. | 324/380 |
| 6,743,010 | B2 * | 6/2004 | Bridgeman et al. | 431/278 |
| 2002/0160325 | A1 | 10/2002 | Deng | |
| 2006/0257804 | A1 * | 11/2006 | Chian et al. | 431/24 |
| 2009/0191494 | A1 * | 7/2009 | Galfrascoli et al. | 431/13 |

FOREIGN PATENT DOCUMENTS

| | | |
|---|---|---|
| CN | 101338913 | 1/2009 |
| JP | S62-138626 | 6/1987 |
| JP | H07280257 | 10/1995 |
| JP | H10160160 | 6/1998 |
| JP | H10285731 | 10/1998 |

(Continued)

OTHER PUBLICATIONS

Search Report from the Intellectual Property Office of Taiwan issued Dec. 27, 2013 for TW 100126863.

(Continued)

*Primary Examiner* — John K Fristoe, Jr.
*Assistant Examiner* — Jessica Cahill

(57) ABSTRACT

An ignitor spark indicator 100 is described that monitors RF signals within a flame rod 25 located near a spark rod 23. The signal from the flame rod 25 is processed to provide a waveform that indicates when electrical arcing is occurring. The indication when arcing is occurring is also provided to flame-detecting equipment. The flame-proving device 60 only operates when the arcing is not produced so that the flame-detecting device 60 does not confuse the arcing with a flame reducing the false positive determinations.

15 Claims, 6 Drawing Sheets

(56) References Cited

FOREIGN PATENT DOCUMENTS

| | | |
|---|---|---|
| JP | 2002-13731 | 1/2002 |
| JP | 2003-21331 | 1/2003 |
| JP | 2006-118725 | 5/2006 |

OTHER PUBLICATIONS

Notification of Reasons for Refusal from the Japanese Patent Office dispatched Feb. 3, 2014 for JP 2013-521804.

* cited by examiner

IGNITOR SPARK STATUS INDICATOR

FIELD OF THE INVENTION

The present invention is directed to a system for more accurately indicating if a spark and a flame are being produced in a fuel ignitor.

BACKGROUND

In typical gas and light oil-fueled utility burners, the gas/oil is ignited from a pilot flame on an ignitor. The ignitor must start this pilot flame. Therefore, it creates a spark from a spark rod connected to a high voltage transformer. The transformer provides high voltage electrical power (about 8 kV) to the spark rod that is adjacent to a grounded metal housing. The electrical power causes an arc (spark) to be produced between the spark rod and housing (ground). This arc occurs for a predefined time (typically 10 seconds) when the ignitor is first turned on. In prior art devices there are no external verifications that arcing is actually occurring.

The ignitor also has a flame rod located near a small fuel source, the spark rod and the housing. The spark rod creates arcing that lights the fuel from the small fuel source creating the pilot flame. The pilot flame spans the area between the flame rod and the housing. Since fire conducts electricity, this causes current to flow from the flame rod to the housing through the flame.

This current is monitored by an externally mounted electronic device. The electronic device and flame rod are referred to as a flame-proving device. The flame-proving device analyzes the flow of current from the flame rod to the housing to determine the presence of a pilot flame.

The arc from the high voltage transformer sometimes interferes with the ignitor flame-proving device, causing it to falsely indicate flame while the arc is on.

When an ignitor will not correctly light a pilot flame, the technician diagnosing the problem will usually remove the ignitor from the boiler and activate it without fuel to visually determine if an arc is being produced. This takes time and effort.

Currently, there is a need for a device that automatically determines if an ignitor is producing arcing and more accurately determines if a pilot flame is being produced.

SUMMARY OF THE INVENTION

The present invention may be embodied as an ignitor diagnostic device 100 for detecting the presence of arcing between an energized spark rod 23 and a housing 11. It employs a flame rod 25 for sensing an electromagnetic (EM) signal radiated by the spark rod 23 when energized.

A sensing device 50 is coupled to the flame rod 25 and receives the EM signal from the flame rod 25 and processing the EM signal to create a spark indication signal.

A user interface 90 adapted to provide output to a user.

A logic unit 60 is coupled to the user interface 90. The logic unit 60 is adapted to receive the spark indication signal from the sensing device 50, determine if arcing is occurring based upon the strength of the spark indication signal. The logic unit 60 provides this information to the user interface 90 to cause an output to be displayed to the user.

The spark indication signal is comprised by a plurality of periodic lobes separated by low voltage timer periods, and the logic unit 60 monitors the low voltage time periods in the spark indication signal and measures the spacing between lobes to indicate 'health' of the spark producing equipment.

The present invention may also be embodied as an ignitor diagnostic device 100 for more accurately determining if a pilot flame is present.

It includes a flame rod 25 for sensing an electromagnetic (EM) signal radiated by the spark rod 23 when the spark rod 23 is energized, a sensing device 50 coupled to the flame rod 25 for receiving the EM signal from the flame rod 25 and processing the EM signal to create a spark indication signal;

a logic unit 60 adapted to receive the spark indication signal from the sensing device 50, determine if arcing is occurring based upon the strength of the spark indication signal and provide a logic signal indicating when arcing is occurring; and a flame-proving device 70 coupled to the logic unit 60 adapted to receive the logic signal from the logic unit 60 and only test for a pilot flame when the logic signal indicates that no arcing is occurring.

OBJECTS OF THE INVENTION

It is an object of the present invention to provide a system that accurately determines if an ignitor is producing a spark.

It is another object of the present invention to indicate to a flame detector that an arc is currently being produced.

It is another object of the present invention to aid a flame detector in more accurately determining if there is currently a pilot flame burning.

It is another object of the present invention to indicate when there are problems with the spark apparatus.

It is another object of the present invention to predict failures of the spark apparatus.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENTS

Figure 1:
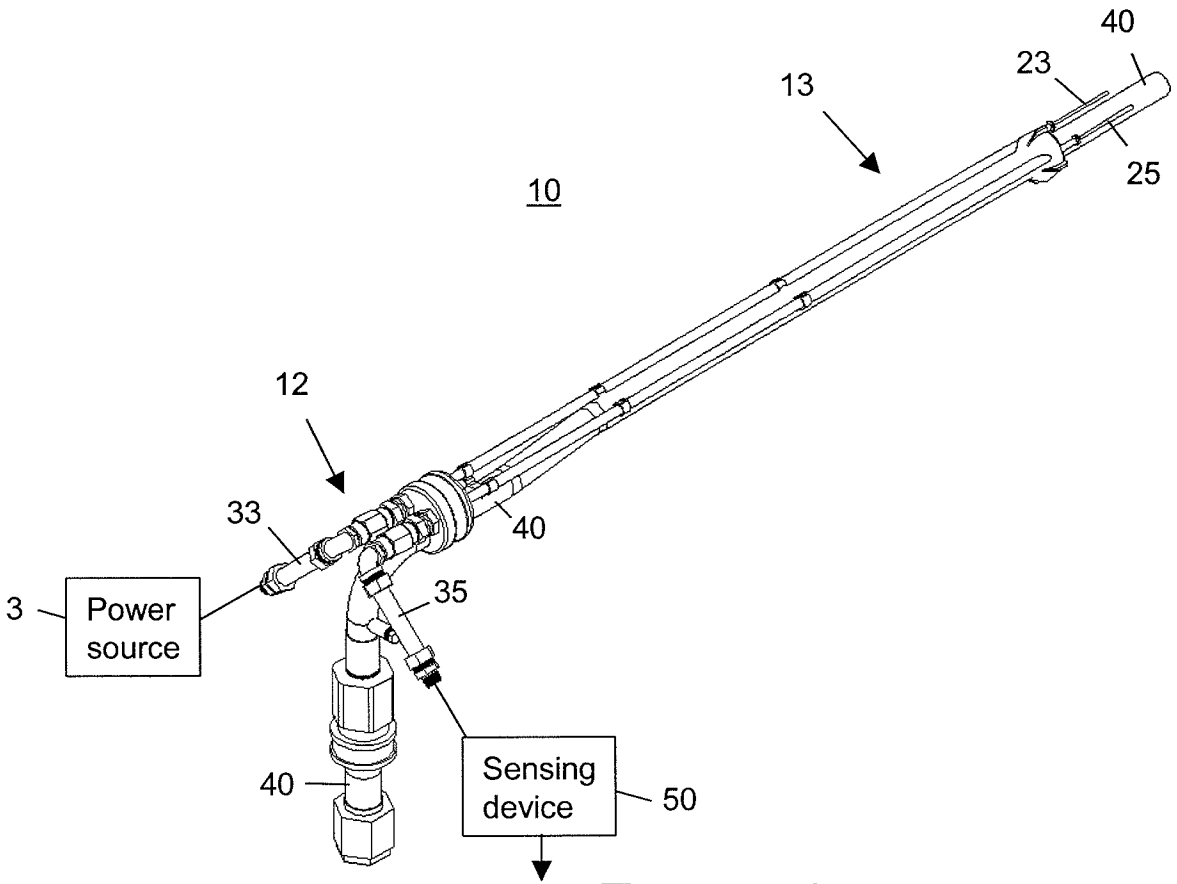
FIG. 1 is a perspective view of a pipe ignitor compatible with the present invention with its housing removed.

FIG. 1 is a perspective view of a pipe ignitor 10 compatible with the present invention with its housing removed.

Figure 2:
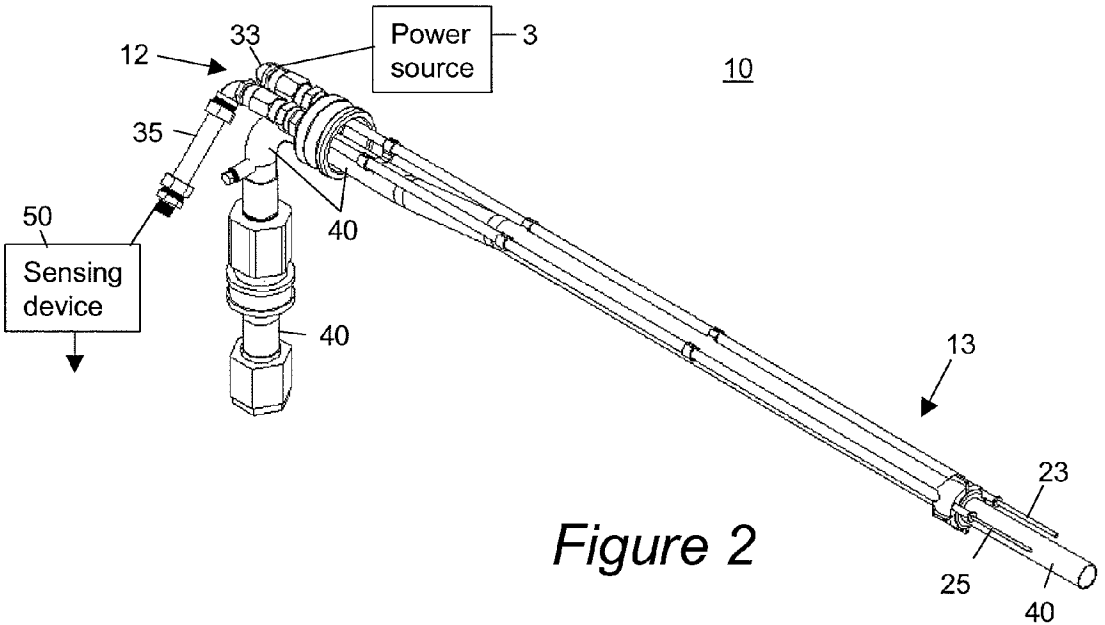
FIG. 2 is a perspective view from a different angle of a pipe ignitor compatible with the present invention with its housing removed.

FIG. 2 is a perspective view from a different angle of a pipe ignitor 10 compatible with the present invention with its housing removed.

Figure 3:
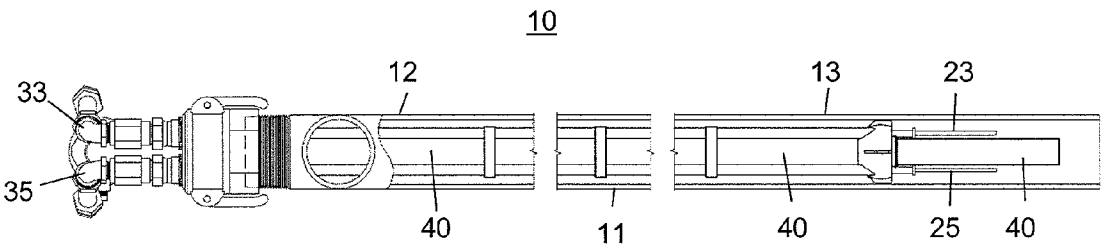
FIG. 3 is a partially cut-away diagram of a pipe ignitor compatible with the present invention.

FIG. 3 is a partially cut-away diagram of a pipe ignitor 10 compatible with the present invention.

The following description is made with reference to FIGS. 1, 2 and 3. Pipe ignitor 10 has an elongated housing 11 having an internal end 13 passing inside of a combustion chamber of a boiler and an external end 12 extending outside of the combustion chamber.

The external end 12 has a spark rod cable 33 and a flame rod cable 35 extending out to external equipment. Internally, the spark rod cable 33 connects to an electrically conductive spark rod 23. Spark rod 23 extends from the spark rod cable 33 to the internal end 13. It extends parallel to, but does not come in contact with, the outer housing 11. The outer housing 11 is electrically connected to ground. There is a predetermined gap between spark rod 23 and outer housing 11.

High voltage electric power source 3 provides electric power, preferably in the form of alternating current, through the spark rod cable 33 and to the spark rod 23. This causes pulsating arcing between the spark rod 23 and the internal end 13 of housing 11. This arcing produces high frequency electro-magnetic radiation and induces current flow in nearby conductors.

A flame rod 25 is enclosed within the outer housing 11 and extends to the internal end 13 of the pipe ignitor 10. It is positioned between the fuel tube 40 and the end of spark rod 23. This allows the flame rod 25 to be immersed in a pilot flame when the pilot flame is burning.

Flame rod 25 is connected to a flame rod cable 35 that connects ultimately to a flame-proving device that detects the presence of a pilot flame.

Figure 4:
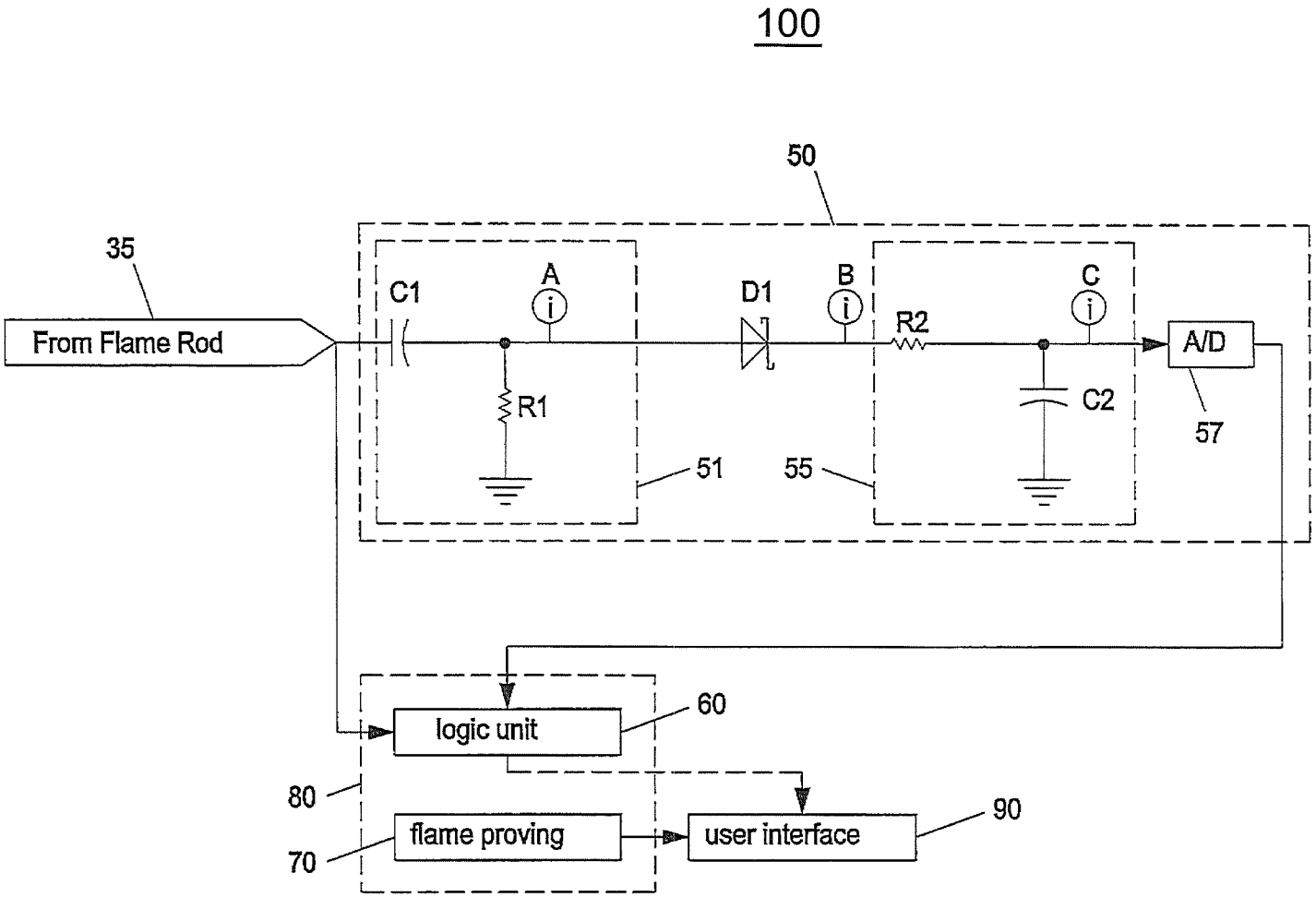
FIG. 4 is a schematic block diagram of the general elements for one embodiment of a circuit according to the present invention for processing a signal received from the flame rod.

Referring now also to FIG. 4, one type of flame-proving device 70 measures electrical current passing through a flame. Flame-proving device 70 applies a voltage difference between the flame rod 25 and the housing (ground). Since the pilot flame (fire) conducts electricity, the pilot flame between the fuel tube 40 and the housing 11 creates a circuit allowing current to flow from the flame rod through the pilot flame and to the housing 11. This is typically about 30 volts. This current is measured by the flame-proving device 70. The presence of electrical current flow indicates that a pilot flame is present. Conversely, the absence of current flow indicates that a pilot flame is not present.

The present inventors discovered that the flame rod 25 could act as an antenna as well as functioning to provide current through the pilot flame. It was also determined that the arcing produced by the spark rod 23 creates high frequency RF 'splatter' radiation that was being sensed by the flame rod 25. The characteristic AC pulsing is sensed by the flame rod 25. Therefore, it was determined that the signal sensed by the flame rod 25 can be monitored to indicate when the spark rod 23 is creating arcing. This signal also indicates that a spark is being produced. This information may also be used to determine when the spark rod and associated power source are not functioning properly. It also may be used to cause the flame-proving device to sense the flame only when no arcing is being produced, and therefore detect the flame more accurately.

The theory of the present invention is to monitor electrical signals sensed by the flame rod 25, filter out the DC and low frequencies in the sensed signal, rectify the signals, filter out the high frequencies and digitize the signal. This leaves a low frequency envelope signal that is twice the frequency of the AC current used (100 Hz. or 120 Hz.). When this signal is detected, the spark rod 23 is arcing.

The arcing of the spark rod 23 creates current that may be mistaken by the flame-proving device 70 as originating from a flame and incorrectly indicates that a flame is present when it is not. This is a false positive. Therefore, the sensing device 50 of the present invention must communicate with the flame-proving device 70 to indicate when arcing is occurring.

The flame-proving device 60 must then test for a flame only when the spark rod is not operating to detect if there is a flame.

This eliminates the interference and false-positives that occur due to the inadvertent detection of arcing and confusing the arcing with the presence of a pilot flame. This results in a more accurate flame-proving device.

FIG. 4 shows a schematic block diagram of the general elements for one embodiment of a sensing device 50 according to the present invention for sensing when arcing is occurring. The signal from the flame rod 25 is received through the flame rod cable 35 and provided to a high pass filter 51. High pass filter 51 employs a capacitor C1 and resistor R1 connected to ground that will block lower frequencies in the signal caused by flame impingement on the flame rod 25. High pass filter 51 passes the higher frequency signal due to the arcing radiation "splatter". One such signal is that shown in FIG. 5.

Figure 6:
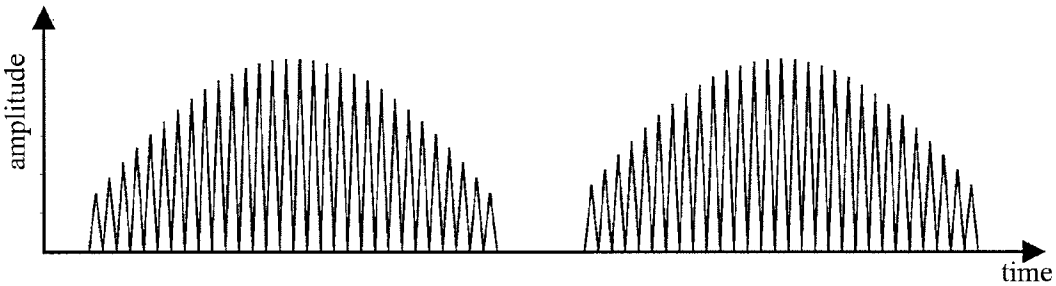
FIG. 6 is an illustration of a waveform monitored at test point "B" of the circuit of FIG. 4.

The filtered signal passes through a rectifier D1 that rectifies the signal to flip the negative lobes to make them all positive. This signal is shown in FIG. 6.

The rectified signal is provided to a low pass filter 55. Low pass filter 55 in this embodiment employs a resistor R2 and capacitor C2 that block the high frequency arcing signal to produce an envelope signal. The envelope signal has a frequency that is twice the frequency produced by the AC power supply. The signal is shown in FIG. 7.

Figure 7:
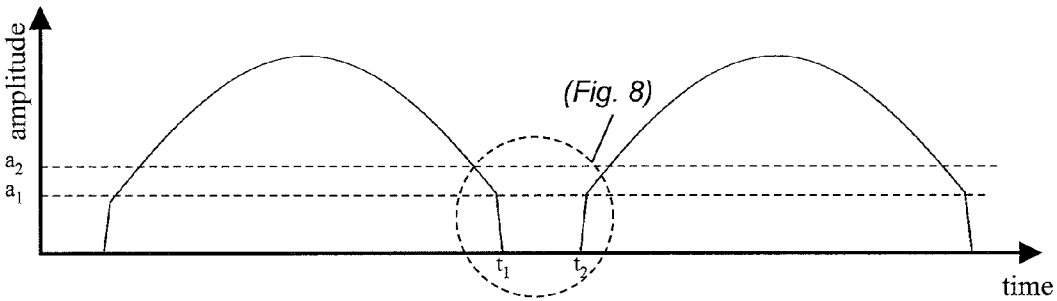
FIG. 7 is an illustration of a waveform monitored at test point "C" of the circuit of FIG. 4.

An analog to digital converter 57 receives the analog envelope signal and digitizes it to create a set of digital samples approximating the analog envelope signal of FIG. 7. This may be in the form of a series of measured amplitude values, or a block or table of such data.

A logic unit 60 senses the digitized signal provided by the ND converter 55. Logic unit 60 may be a standalone device with its own microprocessor or be part of a calculation device 80 that has a microprocessor that runs several different programs and performs several different functions. One embodiment compares the amplitude of the digitized signal with a minimum amplitude, such as $a_2$ of FIGS. 7 and 8.

Logic unit 60 then monitors the digitized signal to identify if the signal is at periodic peaks that exceed the threshold with a regular frequency. This frequency should be double the frequency of the signal provided by the spark power supply (3 of FIGS. 1, 2) to the spark rods (23 of FIGS. 1, 2). If so, arcing is being produced. If not, then no arcing is being produced.

Logic unit 60 receives the signal from the sensing device 50 and calculates information that there is, or is not, arcing being produced. This information is provided from the logic unit 60 to the flame-proving device 70. Flame-proving device 70 is modified in this embodiment to operate when the output of the logic unit 60 indicates that no arcing is being produced. It is not allowed to operate when the logic unit 60 indicates that arcing is being performed.

In an alternative embodiment, the flame-proving device 70 is allowed to operate at all times, but readings indicating that there is a flame present while logic unit 60 indicates that arcing is being performed are ignored.

Figure 5:
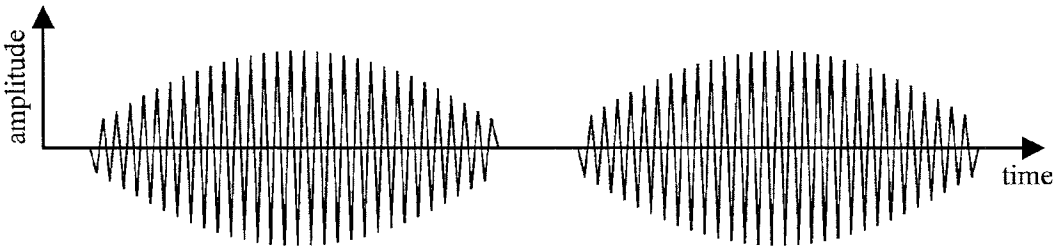
FIG. 5 is an illustration of a waveform monitored at test point "A" of the circuit of FIG. 4.

FIG. 5 is an illustration of a waveform monitored at test point "A" of the circuit of FIG. 4. Here the high frequency signal has an envelope with a frequency that follows the AC input frequency.

FIG. 6 is an illustration of a waveform monitored at test point "B" of the circuit of FIG. 4. Here the signal of FIG. 5 has been rectified, flipping the signal lobes to the positive side.

FIG. 7 is an illustration of a waveform monitored at test point "C" of the circuit of FIG. 4. Here the resultant signal is only the envelope of the rectified AC input frequency. The high frequency signal due to the arcing has been filtered out.

Figure 8:
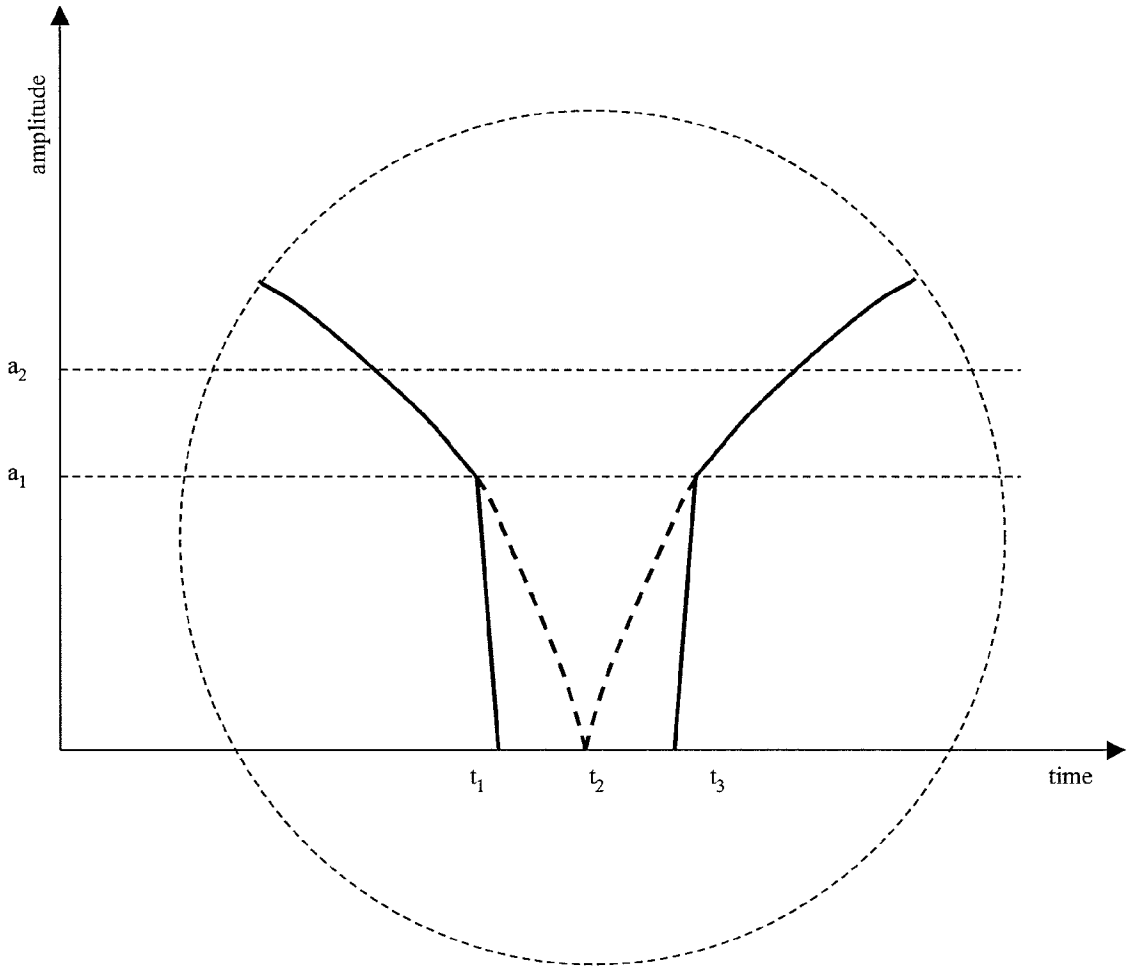
FIG. 8 is an enlargement of a portion of the waveform shown in FIG. 7.

FIG. 8 is an enlargement of a portion of the waveform shown in FIG. 7.

This is a time vs. amplitude plot of the envelope of the rectified waveform. As the waveform envelope reduces amplitude (input voltage), it reaches a point at time $t_1$ that the curve drops to zero amplitude.

Similarly, as voltage is provided by the power source 3 to the spark rod 23 during the period from time=$t_2$ to time just before $t_3$, there is no measurable amplitude response. It is only at time=$t_3$ that arcing begins and increases its amplitude rapidly until it follows the normal waveform envelope.

It has been determined that the health of the power source 3, spark rod 23, the spark rod cable 33 and the remainder of the connections between these units can be determined by the distances between $t_1$ and $t_3$.

The probability of failure may be determined not only by these distances, but by how these distances change over time.

Referring now to FIGS. 4 and 8, optionally, logic unit 60 measures the amplitudes and times shown in FIG. 8. It then compares these measurements to predetermined thresholds or optimum measurements to determine health of the system. Based on the deviations from the thresholds, one can determine how 'healthy' the system is.

Also, if the logic unit 60 is capable of storing historic data, the change over time can be determined and a prediction may be made as to when the system will fail. This can be very useful in the maintenance and repair of these ignitors.

Figure 9:
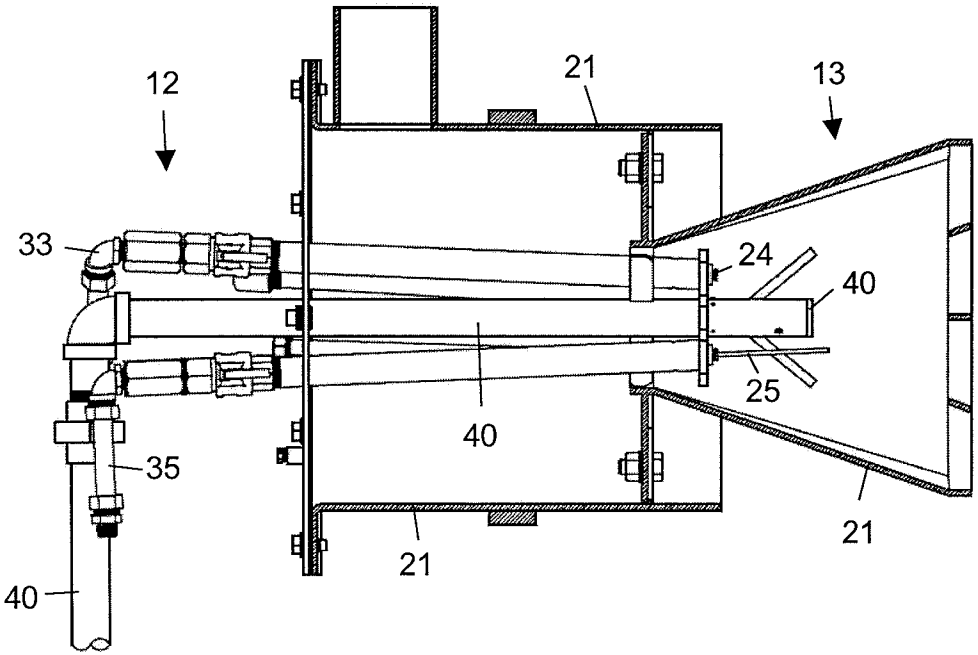
FIG. 9 is a cross sectional, elevational view of a side ignitor compatible with the present invention as it would appear installed within a boiler.

FIG. 9 shows a variation of the pipe ignitor 10. This is a side ignitor. All of the parts have the same function as those with the same reference numbers that have been previously described. Housing 21 is different since this is intended to be mounted in the sidewall of a boiler. Also, spark plug 24 is employed instead of a spark rod 23. This is due to the different geometry that makes it difficult to be close to the housing. Therefore, spark plug 24 has both a positive and negative electrode spaced by a gap to create a spark similar to spark plugs in an average automobile.

It should be emphasized that the above-described embodiments of the present invention, particularly any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention.

What is claimed is:

1. An ignitor diagnostic device for detecting the presence of arcing between an energized spark rod and a housing, comprising:

a flame rod for sensing a electromagnetic (EM) signal radiated by the spark rod when energized;

sensing device coupled through a flame rod cable to the flame rod for receiving the EM signal from the flame rod and processing the EM signal to create a spark indication signal;

a user interface adapted to provide output to a user; and a logic unit coupled to the user interface, the logic unit adapted to receive the spark indication signal from the sensing device, determine if arcing is occurring based upon the strength of the spark indication signal and provide a result of the determination to the user interface to cause an output to be displayed to the user.

2. The ignitor diagnostic device of claim 1 wherein the sensing device comprises:

a high-pass filter for blocking the low frequencies out of the EM signal from the flame rod, and a rectifier (D1) coupled to an output of the high-pass filter for rectifying the signal from the high-pass filter.

3. The ignitor diagnostic device of claim 2 wherein the sensing device further comprises:

a low-pass filter coupled to an output of the rectifier (D1) for creating an analog spark indication signal.

4. The ignitor diagnostic device of claim 3 wherein the sensing device further comprises an analog to digital (A/D) converter coupled to an output of the low pass filter for converting the analog spark indication signal to the spark indication signal.

5. The ignitor diagnostic device of claim 4 wherein the spark indication signal is comprised by a plurality of periodic lobes separated by low voltage timer periods, and the logic unit monitors the low voltage time periods in the spark indication signal and measures the spacing between lobes.

6. The ignitor diagnostic device of claim 5, wherein the logic unit monitors the low voltage time periods in the spark indication signal and employs the monitored time periods to indicate actual spark production relative to a theoretical maximum spark production.

7. The ignitor diagnostic device of claim 5, wherein logic unit is adapted to store past spark indication signals and compare the past spark indication signals with recent spark indication signals to calculate a rate of change of spark performance.

8. An ignitor diagnostic device for determining if a pilot flame is present comprising:

a flame rod for sensing an electromagnetic (EM) signal radiated by the spark rod when the spark rod is energized;

sensing device coupled through a flame rod cable to the flame rod for receiving the EM signal from the flame rod and processing the FM signal to create a spark indication signal;

a logic unit adapted to receive the spark indication signal from the sensing device, determine if arcing is occurring based upon the strength of the spark indication signal and provide a logic signal indicating when arcing is occurring; and a flame-proving device coupled to the logic unit adapted to receive the logic signal from the logic unit and only test for a pilot flame when the logic signal indicates that no arcing is occurring.

9. The ignitor diagnostic device of claim 8 wherein the sensing device comprises:

a high-pass filter for blocking the low frequencies out of the EM signal from the flame rod.

10. The ignitor diagnostic device of claim 9 wherein the sensing device further comprises:

a rectifier (D1) coupled to an output of the high-pass filter for rectifying the signal from the high-pass filter.

11. The ignitor diagnostic device of claim 10 wherein the sensing device further comprises:

a low-pass filter coupled to an output of the rectifier (D1) for creating an analog spark indication signal;

wherein the sensing device further comprises an analog to digital (A/D) converter coupled to an output of the low pass filter for converting the analog spark indication signal to the spark indication signal.

12. The ignitor diagnostic device of claim 11 wherein the spark indication signal is comprised by a plurality of periodic lobes separated by low voltage timer periods, and the logic unit monitors the low voltage time periods in the spark indication signal and measures the spacing between lobes.

13. The ignitor diagnostic device of claim 12, wherein the logic unit measures spacing between lobes to indicate actual spark production relative to a theoretical maximum spark production.

14. The ignitor diagnostic device of claim 12, wherein the logic unit is further adapted to store past spark indication signals and compare the past spark indication signals with recent spark indication signals to calculate a rate of change of spark performance.

15. The ignitor diagnostic device of claim 14 wherein the logic unit is further adapted to use the rate of change of spark performance to predict failure of the device.

* * * * *